US005222821A

United States Patent [19]

Osborne et al.

[11] Patent Number: 5,222,821

[45] Date of Patent: Jun. 29, 1993

[54] PIPE DOPE APPLICATOR APPARATUS

[76] Inventors: Michael E. Osborne, 8440 NE. 138th St., Kirkland, Wash. 98034; John R. Anderson, 21520 E. Lost Lake Rd., Snohomish, Wash. 98290

[21] Appl. No.: 970,446

[22] Filed: Nov. 2, 1992

[51] Int. Cl.[5] ..... B05C 17/00

[52] U.S. Cl. ..... 401/9; 401/10; 401/11; 401/261

[58] Field of Search ..... 401/261, 9-11; 118/DIG. 11

[56] References Cited

U.S. PATENT DOCUMENTS 3,889,628 6/1976 Usab ..... 401/9 X
4,063,827 12/1977 Persson ..... 401/10
4,932,801 6/1990 Osborne .

*Primary Examiner*—Steven A. Bratlie
*Attorney, Agent, or Firm*—Henderson & Sturm

[57] ABSTRACT

A pipe dope applicator apparatus (10) for coating the threaded ends (201) of pipes (200) having different diameters; wherein, the apparatus (10) comprises a plurality of nesting apertured cup members (20) retained within the cap member (50) of the apparatus (10); and, at least one apertured cup member (20) captively engaged between a collar member (40) and a dope filled tube member (30); wherein, the collar member (40) is releasably attached to the tube member (30), and the cap member (50) is releasably attached to the collar member (40); and, wherein the apertured cup members have different sized openings to accommodate pipes (200) of different diameters.

5 Claims, 2 Drawing Sheets

PIPE DOPE APPLICATOR APPARATUS

TECHNICAL FIELD

The present invention relates to coating and applicator devices in general, and in particular to an applicator for applying a lubricating material to the threads of pipes of varying diameters.

BACKGROUND ART

As can be seen by reference to the following U.S. Pat. Nos. 4,932,801; 4,466,452; 3,765,983; and 2,810,145; the prior art is replete with myriad and diverse applicators for applying liquid coating to different substrates.

While all of the aforementioned prior art constructions are more than adequate for the basic purpose and function for which they have been specifically designed, these prior art lubricators are in most instances unsuitable for the environment of the present invention in that they are unable to accommodate different sizes of pipe; and, are designed for applying relatively non-viscous liquids. These constructions are also usually inefficient at best when confronted with extremely thick, non-free flowing material; or when confronted with a variety of pipe sizes, that need to have pipe dope applied.

As a consequence of the foregoing situation, there has existed a longstanding need for a pipe dope lubricating applicator apparatus which facilitates the application of viscous liquids to the cylindrical threaded ends of various size pipes wherein the workman can manipulate the pipe and/or the applicator to quickly and uniformly coat the necessary surface area prior to joining sections together; and, the provision of such a construction is a stated objective of the present invention.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

DISCLOSURE OF THE INVENTION

Briefly stated, the pipe dope applicator apparatus that forms the basis of the present invention was developed to control the application of a viscous liquid such as pipe dope onto the threaded end of a pipe.

Another object of the present invention is the ability to accommodate a variety of different pipe diameters quickly and efficiently.

The pipe dope application apparatus comprises in general: a receptacle unit and a metering cup unit. The metering cup unit comprises three metering cup members whereby each cup member has a different diameter to accommodate different sizes of pipe and the sides of the cup members are provided with a plurality of elongated metering apertures.

The receptacle unit comprises in general a receptacle tube member, a retainer member, and a cap member; wherein, the retainer member sealingly locks the cap member to the tube member; wherein, the cap member stores the two unused cup members.

As will be explained in greater detail further on in the specification, when a plumber or a workman wishes to apply pipe dope to the end of a threaded pipe all that is necessary is for the individual to insert the end of the pipe into the mouth of the corresponding metering cup and push gently against the bottom of the metering cup while rotating the pipe and relative to the metering cup. As the pipe end is rotated relative to the metering cup, a generally uniform coating of pipe dope will be deposited on the pipe threads.

BEST MODE FOR CARRYING OUT THE INVENTION

Figure 3:
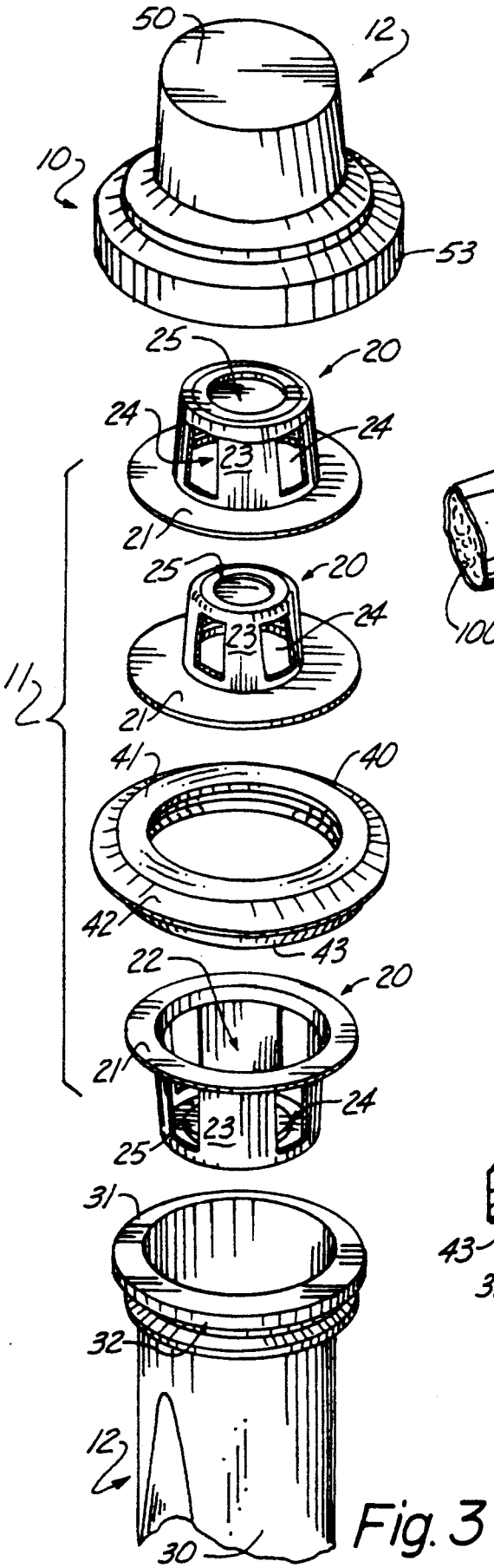
FIG. 3 is an exploded perspective view of the apparatus.

As can be seen by reference to the drawings, and in particular to FIG. 3. the pipe dope applicator apparatus that forms the basis of the present invention is designated generally by the reference numeral (10). The pipe dope applicator apparatus (10) comprises in general: a metering cup unit (11) and a receptacle unit (12). These units will now be described in seriatim fashion.

Still referring to FIG. 3, it can be seen that the metering cup unit (11) comprises a plurality of nesting metering cup members (20); wherein, each metering cup member is provided with a uniform diameter lip portion (21) having a central opening which defines a cup mouth (22). In addition each cup member (20) has downwardly depending side walls (23) provided with elongated spaced apertures (24) and a bottom portion (25).

Furthermore each of the cup members (20) have different diameter mouths (22) which are dimensioned to loosely receive the threaded ends (201) of different diameter pipes (200).

Figure 5:
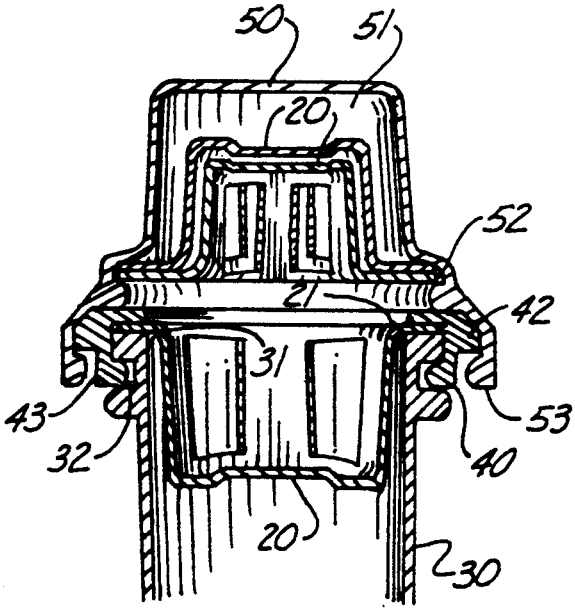
FIG. 5 is a cross-sectional view of the apparatus in its stored configuration.

As can best be appreciated by reference to FIGS. 3 and 5, the receptacle unit (12) comprises a tube member (30) a collar member (40) and a cap member (50). The tube member (30) includes a pipe dope reservoir whose open end is provided with an enlarged lip portion (31) having a peripheral recess (32), whose purpose and function will be described presently.

As shown in FIGS. 3 and 5, the collar member (40) is provided with a flat top surface (41) an outwardly projecting side-rim portion (42) and a reduced diameter downwardly depending detent skirt (43). As can be seen particularly by reference to FIG. 5, each of the outer edges of the lip portions (21) of the cap members (20) are dimensioned to be selectively held captive between the collar member (40) and the lip portion (31) of the tube member (30) when the detent skirt (43) of the collar member (40) is received in the peripheral recess (32) which surrounds the lip portion (31) of the tube member.

Still referring to FIG. 5, it can be seen that the cap member (50) has an enlarged internal chamber (51) dimensioned to receive one or more of the cup members (20); wherein, the interior of the cap member (50) is provided with a stepped recess (52) dimensioned to releasably engage the lip portions (21) of the nested cup members (20). In addition, the bottom portion of the cap member (50) is provided with an outwardly projecting beaded flange (53) dimensioned to engage the side-rim portion (42) of the collar member (40) in a snap-fit fashion.

Figure 1:
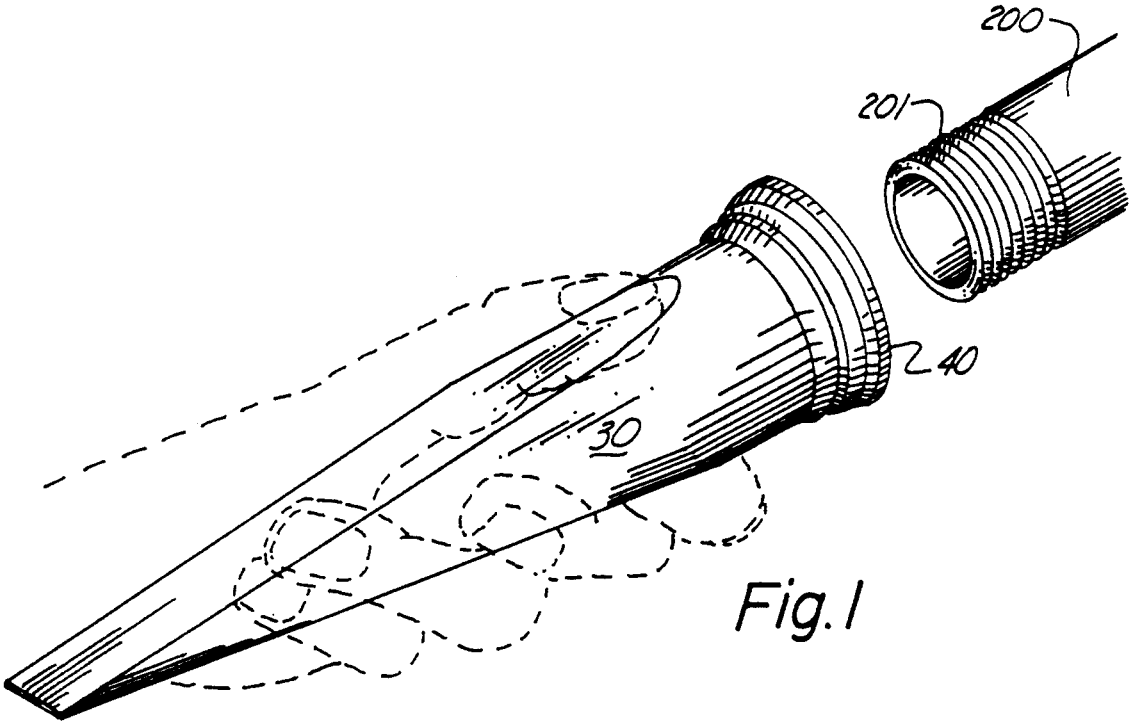
FIG. 1 is a rear perspective view of the pipe dope applicator apparatus which forms the basis of the present invention in use.
Figure 2:
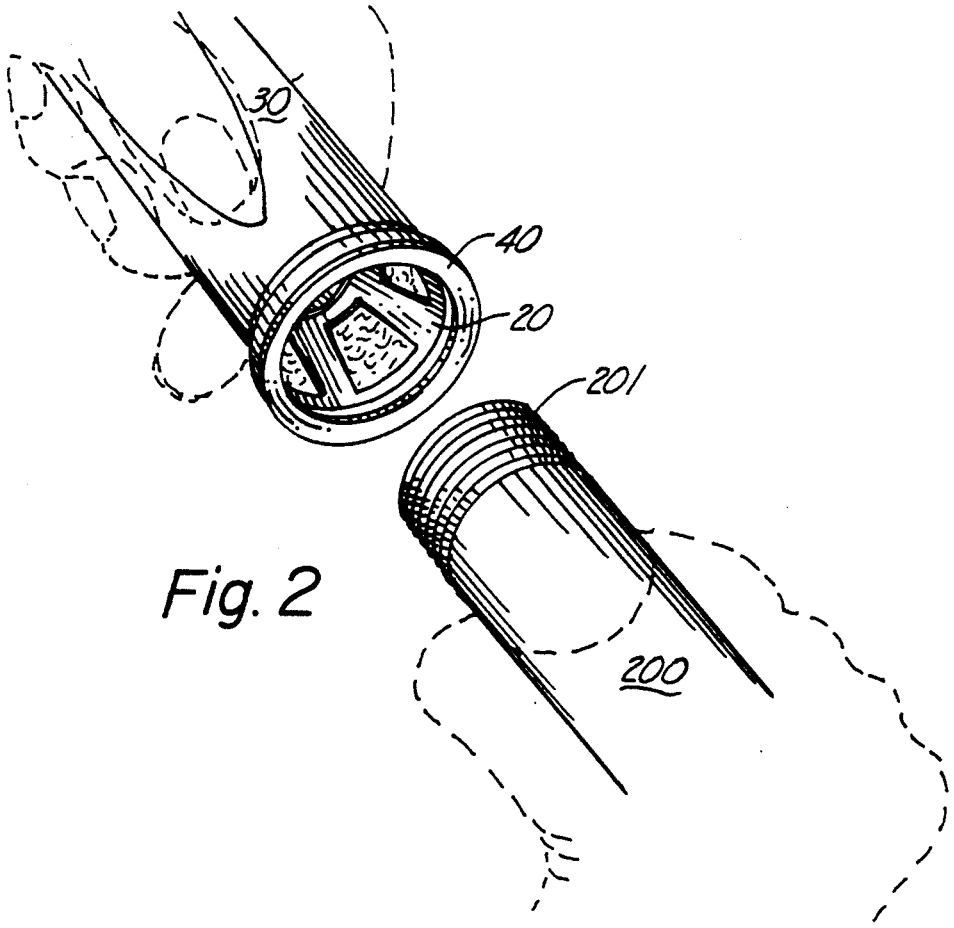
FIG. 2 is a front perspective view of the applicator apparatus in use.
Figure 4:
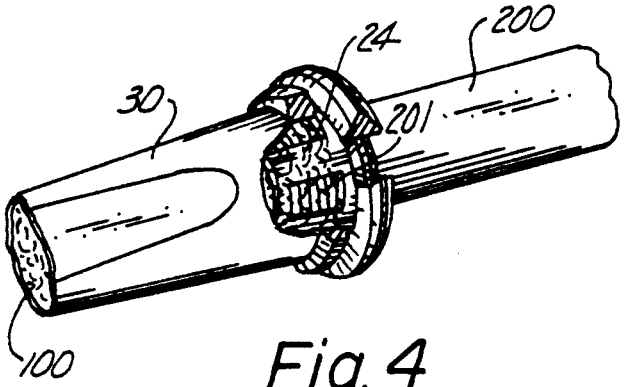
FIG. 4 is a partial cross-sectional view of the apparatus in use.

As shown in FIGS. 1, 2 and 4, when the apparatus (10) is ready for use, a selected cup member (20) is captively engaged between the tube member (30) and the collar member (40) such that pipe dope (100) can flow through the apertures (24) in the side walls of the cup member (20) to coat the threaded end (201) of a suitably dimensioned pipe (200). Depending on the size of the pipe (200) to be treated, different sized cup members (20) can be employed with the tube member (30) while the remaining cup members (20) may be stored inside the cap member (50). Then when, the job is complete, the cap member 50) containing the stored extra cup members (20) can be reattached to the collar member (40) on the tube member (30) to prolong the useful life of the pipe dope (100) contained within the receptacle unit.

Having thereby described the subject matter of the present invention, it should be apparent that many substitutions, modifications and variations of the invention are possible in light of the above teachings. It is therefore to be understood that the invention as taught and described herein is only to be limited to the extent of the breadth and scope of the appended claims.

I claim:

1. A pipe dope applicator apparatus for applying pipe dope to the ends of threaded pipes wherein the apparatus comprises:

a tube member containing pipe dope and having an enlarged lip portion a first apertured cup member having a lip portion of a given diameter surrounding an opening defining the mouth of the cup member and further provided with apertured side walls; wherein, the opening is dimensioned to receive the threaded end of a pipe having a selected diameter a collar member dimensioned to overlie the lip portion of said first cup member and provided with means for captively engaging said first cup member between the collar member and the tube member.

2. The apparatus as in claim 1 further comprising a cap member having means for captively engaging said collar member to form a closure for the tube member.

3. The apparatus as in claim 2 further including a plurality of apertured cup members having lip portions with the same diameter as said first cup member and having openings of different diameters than each other as well as the opening in said first cup member; wherein, said openings are dimensioned to receive the ends of the threaded pipes having different diameters.

4. The apparatus as in claim 3; wherein, said cap member is provided with an enlarged interior chamber dimensioned to receive said plurality of cup members in a nesting fashion.

5. The apparatus as in claim 4; wherein, said cap member is further provided with means for releasably receiving the peripheral edge of the lip portion of at least one of the cup members.

* * * * *